United States Patent [19]

Eriksson

[11] Patent Number: 4,856,241

[45] Date of Patent: Aug. 15, 1989

[54] DEVICE FOR FASTENING DOORS AND WINDOWS TO A WALL OPENING

[75] Inventor: Lars Eriksson, Emmaboda, Sweden

[73] Assignee: Lars Lagergren, Sweden; a part interest

[21] Appl. No.: 273,645

[22] Filed: Nov. 14, 1988

Related U.S. Application Data

[63] Continuation of Ser. No. 52,042, May 6, 1987, abandoned.

[30] Foreign Application Priority Data

Sep. 9, 1985 [SE] Sweden ..... 8504172

[51] Int. Cl.[4] ..... E06B 1/52; E06B 1/60

[52] U.S. Cl. ..... 52/217; 49/505; 292/67

[58] Field of Search ..... 52/210, 206, 211, 212, 52/213, 217; 312/242; 49/505, 504; 292/76, 79, 87

[56] References Cited

U.S. PATENT DOCUMENTS

| | | | |
|---|---|---|---|
| 1,068,899 | 7/1913 | Hepburn | 292/76 |
| 1,403,910 | 1/1922 | Moon | 292/76 |
| 1,566,632 | 12/1925 | Swenson | 292/76 |
| 1,581,693 | 4/1926 | Seeholzer | 292/76 |
| 1,636,697 | 7/1927 | Larson | 292/76 |
| 1,732,940 | 10/1929 | Larson | 292/76 |
| 1,827,810 | 10/1931 | Cooper | 292/76 |
| 3,420,003 | 1/1969 | Cline | 52/212 |
| 3,584,418 | 6/1971 | Penkala | 49/505 |
| 3,859,764 | 1/1975 | Cary | 52/217 |
| 3,992,833 | 11/1976 | Hulinsky | 52/213 |
| 4,679,366 | 7/1987 | Hitchens | 52/217 |

FOREIGN PATENT DOCUMENTS

| | | | |
|---|---|---|---|
| 340661 | 12/1977 | Austria . | |
| 2330839 | 6/1977 | France | 52/213 |
| 399581 | 12/1975 | Sweden . | |
| 448452 | 4/1968 | Switzerland . | |

*Primary Examiner*—John E. Murtagh

*Attorney, Agent, or Firm*—Ostrolenk, Faber, Gerb & Soffen

[57] ABSTRACT

A fastening device for door, windowframes or cases comprising an adjusting screw attachable in a wall opening and a locking plate cooperating with said screw and fixable in said frame. The locking plate is attachable against the end border of the frame faced towards the edge of the wall opening. From the fastening plate of said locking plate a locking means protrudes allowing connection selectable in a longitudinal direction of said frame to a snap in connection provided at the upper part of the adjusting screw and provided to engage the locking plate.

5 Claims, 1 Drawing Sheet

DEVICE FOR FASTENING DOORS AND WINDOWS TO A WALL OPENING

Figure 1:
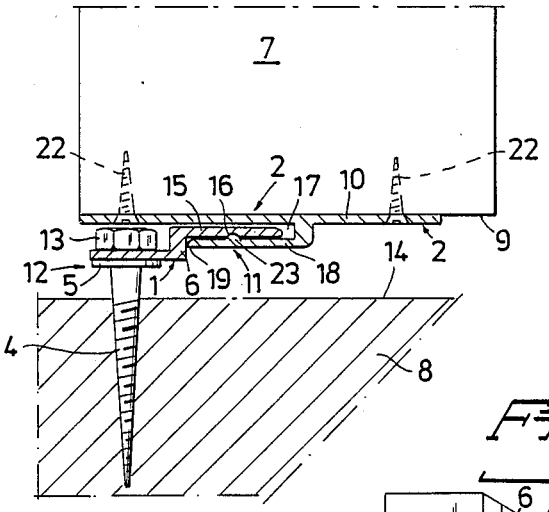

The is a continuation of application Ser. No. 52,042 filed on May 6, 1987 now abandoned.

The present invention relates to a fastening means preferably for door or window frames or cases, which fastening means comprises an adjusting screw attachable in a wall opening or the like and a locking means cooperating with said screw and being fixable in said frame or the like.

Existing fastening means on the market which are intended for frames or the like often consist of screw means comprising a screw extending through the frame and continue into the edge of that opening in the wall, in which the frame is to be fixed. The screw is provided with an outer threaded part for a casing which is intended to be screwed by aid of its outer thread into a bore made through the frame in a direction to edge part of the opening. The screw of the fastening means can be adjusted after mounting in the edge part of the wall opening in such a way that the frame is displaceable towards and out from the edge part because the screw is rotated to the one or the other direction. The casing is now situated and screwed into the position in the frame. When the frame is adjusted to its proper position in the wall opening the bores in the frame for the screws are concealed by cover plates of plastic. Another common way is to wedge up the frame in a vertical horizontal direction and at the same time fix the same by screws and nails.

The object of the present invention is to provide a fastening means of the type above described which eliminates the drawbacks existing in the fastening means previously known while it serves its purpose in an excellent way and owing to its simple structure is cheap to produce. The distinguishing feature of the present invention is that the locking means consists of a locking plate attachable against the end border of said frame faced towards the edge part of the wall opening. From the fastening plate of said locking plate a locking means protrudes allowing a selectable connection in a longitudinal direction of said frame to a snap means provided at the upper part of the adjusting screw and provided to engage the locking means.

Due to the invention there is now achieved a fastening means which does not need any bore to be made through the frames or the cases which are to be mounted. Further no wedges need be used during the mounting. But after having screwed in the adjusting screw of the fastening means at predetermined positions around the edge part of the wall opening the frame, on which during an earlier stage the locking plates of the fastening means have been, for example, screwed on against the end border of said frame, in a simple way can be lifted into the proper position in such a way that the locking means protruding from the locking plates hook-up and connect with the fixing and/or snap means protruding from the upper part of the adjusting screws. After that a further correction can be carried out of the fixing of the frame in the wall opening if necessary by turning around the adjusting screws, which are easily accessible from one or the other side of the frame by a wrench depending on the direction in which the the locking plates have been mounted. Because the locking plates have a length in the circumference direction of the frame which is larger than the hook-up area of the snap means in relation to the locking means of the locking plates the location of the adjusting screws is not critical laterally. This makes the mounting essentially easier. The location of the adjusting screws the direction of depth must be more exact, but this does not involve any difficulties.

Figure 2:
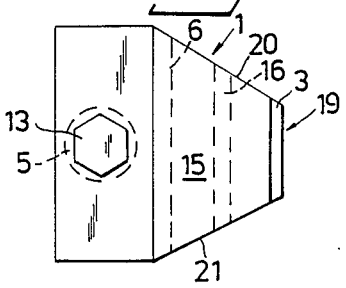
Figure 3:
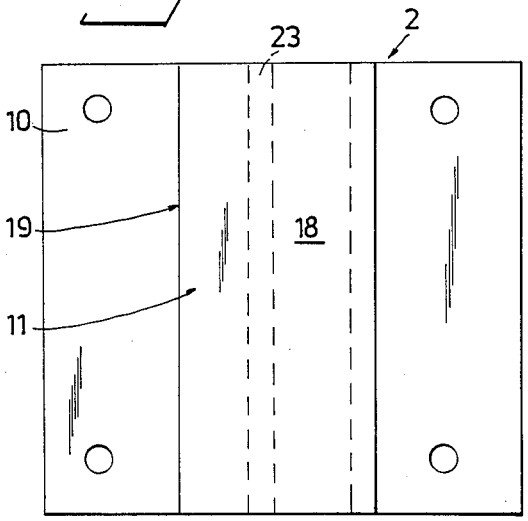

The invention will now be described in detail with reference to the accompanying drawings, in which FIG. 1 illustrates in cross-section an embodiment of the invention in which the fastening means is illustrated in a schematic side view having the locking means of the locking plate mounted in a direction which admits an adjustment of the screw from the left side, FIG. 2 illustrates a view in a larger scale of the adjusting screw from above having a snap means protruding from the upper part of said screw and FIG. 3 is a plan view of the locking plate attachable against the end border of the window frame alternatively in the wall opening and cooperating with the adjusting screw and its snap means.

As can be seen from FIG. 1 the fastening means according to the preferable embodiment of the present invention is intended to be attached between the end border 9 of a door or window frame 7 and an edge part 14 of a wall opening 8. The illustrated fastening means comprises a locking plate 2 intended to be attached, for example, by screws 22 in the end border 9 of the frame 7 and a snap means 1 connectable to the locking plate 2. Said snap means is supported by and fixed to adjusting screw 4 in the edge part 14 of the wall opening 8. In the preferred embodiment of the present invention the snap means 1 is turnably fixed on the adjusting screw 4 but can of course also be formed in a different way, for example, cylindrically and also may be rigidly fixed to the upper part of the screw 4. Alternatively the adjusting screw 4 also can be fixed to the end border 9 of the frame 7 and the locking plate 2 can be fixed to the edge part 14 of the wall opening 8.

The snap means 1 can be turnable around the adjusting screw 4 in a plane as in the example illustrated and is mainly located perpendicularly to the longitudinal direction of the adjusting screw 4. The snap means is provided between a supporting means 5 and the head 13 of the adjusting screw at an upper part 12 of said adjusting screw 4. As can be seen from FIGS. 1 and 2 the snap means 1 comprises a tongue formation 15 protruding from a locking and guiding shoulder 6. The formation is intended for a lockable cooperation and connection with a hook formed locking means 11 protruding from the locking plate 2. Where a locking and guiding shoulder 6 is used the tongue formation 15 is, as can be seen from FIG. 1, displaced in its position via said shoulder 6 at the upper part 12 of the adjusting screw 4 a distance mainly corresponding to the height of the screw head 13. FIG. 2 shows that the snap means 1 can be provided with a tongue formation 15 having sides 20,21 converging in a direction towards its free end 3. Said free end is bevelled The ease insertion of the tongue formation 15 into the hook formation of the locking means 11. Alternatively the tongue formation 15 can be round having friction element in the form of quills, for example for cooperation with the locking means 11 of the locking plate 2.

The locking plate 2 has a fastening plate 10 from which the locking means protrudes. The locking means 11 is formed by a branch 18 extending in parallel to and at a predetermined distance from the fastening plate 10 for forming a locking gap 17, in which the tongue formation 15 of the snap means 1 is insertable and lockable. The locking occurs when the free longitudinal edge 19 of the branch 18 contacts the locking and guiding shoulder 6 of the snap means 1. The width of the locking gap 17 mainly corresponds to the thickness of the tongue formation 15 of the snap means 1. The tongue formation 15 is locked in the locking gap 17 by aid of a locking slot 16 extending across the longitudinal direction of the tongue formation 15. The slot cooperates with a bulge 23 protruding inwards in the locking gap 17 from the branch 18 of the locking means 11.

FIG. 3 shows the locking plate 2 appears in plan view on a greater scale. The length of the locking plate 2 is selectable but should be two to three times the length of the largest width of the snap means 1. As can be seen from the embodiment illustrated the locking plate 2 suitably can be fixed by four screws 22.

The locking plate 2 turned to the left in the preferred case (FIG. 1) can of course also be mounted to the right depending on whether the adjustment of the fastening of the frames or case in the actual wall opening shall be made from the inside or the outside of the frame.

I claim:

1. Fastening means for attaching a frame to the edge of a wall opening, said fastening means comprising:

an adjusting screw attachable to the edge of said wall opening, and a snap means supported by said adjusting screw;

a locking plate for cooperating with said snap means, said locking plate comprising:

a fastening plate attachable against the border of said frame;

a branch extending in parallel to and at a predetermined spacing from said fastening plate, the spacing between said branch and said fastening plate forming a locking gap; and a hook which protrudes from said branch into said locking gap, said hook extending longitudinally across said branch;

said snap means comprising a tongue protruding from a shoulder rotatably fixed to said adjusting screw, said tongue being provided with a longitudinal locking slot which nonreleasably locks together with said hook of said locking plate so as to engage said locking plate while still allowing relative longitudinal movement between said snap means and said locking plate;

said adjusting screw being rotatable for adjusting the position of said snap means with respect to said locking plate.

2. Fastening means according to claim 1, wherein the locking gap has a width substantially corresponding to the thickness of the tongue.

3. Fastening means according to claim 1, wherein said sides of said tongue converge in a direction towards its free end, said free end being bevelled to ease the insertion of said tongue into the locking gap.

4. Fastening means according to claim 1, wherein the locking plate is attachable against the border of the frame by means of screws.

5. Fastening means according to claim 1, wherein said tongue of said snap means is displaced in a direction parallel to the direction in which said snap means is affixed to said adjusting screw by a distance at least corresponding to the height of said adjusting screw.

* * * * *